US008590066B2

(12) United States Patent
Torres et al.

(10) Patent No.: US 8,590,066 B2
(45) Date of Patent: Nov. 26, 2013

(54) OFFSET OUTLET FLUSH VALVE

(75) Inventors: Alberto C. Torres, Hemet, CA (US); David Nichols-Roy, Escondido, CA (US); Dennis D. Woods, Escondido, CA (US)

(73) Assignee: Lavelle Industries, Inc., Burlington, WI (US)

( * ) Notice: Subject to any disclaimer, the term of this patent is extended or adjusted under 35 U.S.C. 154(b) by 2271 days.

(21) Appl. No.: 11/268,319

(22) Filed: Nov. 7, 2005

(65) Prior Publication Data

US 2007/0101486 A1 May 10, 2007

(51) Int. Cl.
*E03D 1/35* (2006.01)

(52) U.S. Cl.
USPC ..... 4/392; 4/390; 4/393

(58) Field of Classification Search
USPC ..... 4/381–384, 390–395
See application file for complete search history.

(56) References Cited

U.S. PATENT DOCUMENTS

| | | | | | |
|---|---|---|---|---|---|
| 432,579 | A * | 7/1890 | Stults | ..... | 4/378 |
| 5,218,725 | A * | 6/1993 | Lipman | ..... | 4/415 |
| 5,754,986 | A * | 5/1998 | Chien | ..... | 4/327 |
| 6,438,767 | B1 * | 8/2002 | Warshawsky | ..... | 4/567 |
| 6,484,327 | B2 * | 11/2002 | Hand | ..... | 4/326 |
| 7,216,373 | B2 * | 5/2007 | Huang | ..... | 4/393 |

* cited by examiner

*Primary Examiner* — Tuan N Nguyen
(74) *Attorney, Agent, or Firm* — Joseph S. Heino; Patrick M. Bergin

(57) ABSTRACT

An offset outlet flush valve has a valve body, the valve body having an inlet comprising an inlet aperture, an overflow tube socket comprising an overflow tube aperture, and an outlet comprising an outlet aperture. The outlet aperture of the valve body, and the wall that defines it, intersects a portion of the inlet aperture and a portion of the overflow tube aperture and the walls that define them. In this way, a water flow continuum is created between the inlet aperture and the outlet aperture and between the overflow tube aperture and the outlet aperture. A number of alternative embodiments of an overflow tube socket and overflow tube are also provided depending upon OEM or after-market application of the offset outlet flush valve.

16 Claims, 13 Drawing Sheets

OFFSET OUTLET FLUSH VALVE

FIELD OF THE INVENTION

The present invention relates generally to plumbing fixtures and to the component parts that are used in them. More particularly, it relates to a flush valve for use in a toilet tank that has a valve body where the flush valve outlet is offset whereby improved flushing capacity and improved overflow capacity is realized and manufacture of the valve body is simplified. It also relates to such a valve body that can be configured for use in original toilet plumbing as provided by a manufacturer or as a replacement item for use in a wide variety of toilet tanks and fixtures as an after-market installed flush valve.

BACKGROUND OF THE INVENTION

A conventional gravity operated flush toilet has several basic components. The china components include a bowl and a tank mounted atop a rear portion of the bowl. The bowl and tank may either be separate pieces or may be molded as a single unitary piece. The plumbing components of the conventional gravity operated flush toilet include a fill valve in the tank that is connected to a water supply line, a flush valve mounted in a hole in the bottom wall of the tank that communicates with the bowl, a flapper valve that normally closes the flush valve, and a lever or push button on the outer wall of the tank that is connected with a chain or other mechanical linkage for momentary lifting of the flapper valve. This allows water stored in the tank to flow rapidly through the flush valve into the bowl to carry waste along with the water through a trap connected to the underside of the bowl and into a waste pipe connected to a sewer line, septic tank or other waste reservoir.

Conventional flush valves for gravity operated toilets are well known in the art. Such flush valves are generally cylindrical and provide a round valve seat for the liftable flapper valve. They are secured within a drain hole located in the bottom wall of the toilet tank from underneath the bottom wall. Typically a large nut is screwed over a male threaded lower portion of the cylindrical flush valve body, on the underside of the bottom wall of the tank. Extending upwardly from and to one side of the flush valve itself is a cylindrical overflow tube. The purpose of the overflow tube is two-fold. First, the overflow tube prevents flooding in the case of water overflow to the tank. The overflow tube thus ensures that a proper water level is maintained within the toilet tank in the condition of overflow. Ideally, the inlet of the overflow tube is set at a point where it is slightly above normal water level, but below the bottom of the flush lever nut that is located on a vertical wall of the tank for actuation of the flushing cycle. The second purpose is that the overflow tube serves as a conduit to the toilet bowl during refilling of the tank, a small amount of water flowing to the tank being diverted through the overflow tube for this purpose. This occurs when the fill valve is re-filling the tank and, via the overflow tube, the toilet bowl, the toilet bowl having been emptied during the siphoning of the water in it during the flushing action.

In the design of the conventional flush valve, this overflow tube is a vertically-extending circularly-tubular structure having a generally vertical axis. The flush valve itself is similarly a vertically-disposed circular structure having a generally vertical axis and also having a central aperture that is greater inner diameter as compared to the diameter of the overflow tube, the flush valve aperture having a cylindrical valve seat defining an inlet at its uppermost portion and an outlet at its lowermost portion. In this configuration, a flow passageway is defined at the bottommost portion of the overflow tube whereby a water flow continuum is created between the overflow tube, the central passageway and the outlet of the central aperture of the flush valve. Water flowing into the overflow tube from the tank flows down the overflow tube, then flows out of the tube at the passageway that is typically disposed at a right angle from the overflow tube, into the central aperture of the flush valve, and then flows through the flush valve outlet. In this configuration, the bulb of the flapper valve can severely restrict the overflow capacity of the flush valve by impinging on the flow area around the bulb, including the passageway between the overflow tube and the flush valve outlet. This becomes especially critical when an original equipment manufacturer (OEM) flapper is later replaced with a new flapper, typically manufactured by another company, to some rather arbitrary specifications. The problem is that adequate overflow capacity is completely overlooked, because the only issue in the consumer's mind is typically how to stop the flapper from leaking. If the passageway between the overflow tube and the flush valve outlet is blocked, even in part, by the flapper valve bulb, then the ability of the overflow tube to do its job is compromised. The flush valve of prior art is also rather difficult to mold as a one-piece item using conventional plastic molding processes.

In the view of these inventors, what is needed is a flush valve having an outlet from the central aperture that is offset from its conventional position. This configuration would place the outlet portion of the central aperture of the flush valve partly underneath the overflow tube, thereby improving overflow capacity of the flush valve. This configuration could also make the flush valve a more compact device, while also making it a high overflow capacity device. The flapper valve seat, or the cylindrical valve seat of the flush valve at the flush valve inlet, would retain its cylindrical shape so as to allow flapper valves of current manufacture to be used with the device. But the axis of the flush valve would be modified. At the inlet of the flush valve, the axis would be directed at somewhat of an angle relative to the vertical at the uppermost portion of the flush valve. At the outlet and at the lowermost portion of the flush valve, the axis would return to vertical. In this way, the lowermost portion of the flush valve would be disposed both below a portion of the overflow valve and below the inlet of the flush valve.

In the view of these inventors, this configuration would also make the device easier to mold. For example, the flush valve described above would eliminate the requirement of molding the lateral section of the passageway through the valve body separately, thus simplifying the mold process, reducing costs, and increasing the durability of the mold. In the conventional molding process, complicated retracting mold cores are required to be used to form the passageway. These disadvantages are avoided by offsetting the outlet of the flush valve such that the core for the bottom of the valve body and the core mold for the overflow tube meet such that an extra horizontal, or lateral, connection, or self-retracting core is not required.

It should also be mentioned that, in the United States, there are two basic markets for toilet flush valves, namely, the OEM market and the after-installation market. The former consists of large toilet manufacturers that assemble and sell complete gravity operated flush toilets including flush valves. The latter consists of hardware and plumbing supply stores that sell to plumbers and home owners for repair and replacement in toilets already installed in residences. Accordingly, it would be desirable to provide the offset outlet flush valve of the present invention in configurations that would allow it to be used in both the OEM and the after-installation markets.

Finally, it is recognized that every gravity operated flush toilet has an optimum fill level that ensures that enough water is in the tank for proper flushing without wasting water or risking incomplete waste carry out. For many years, gravity operated flush toilets in the United States had tanks with capacities of three and one-half, five gallons, or more. More recently, the Environmental Protection Agency (EPA) has mandated that low water consumption toilets be installed in all new construction and during all re-models, with a maximum water usage of 1.6 gallons per flush. Both the older high volume gravity operated flush toilets and the newer low volume gravity operated flush toilets come in a wide range of tank configurations with different optimum fill levels. Because of this, installation of after-market flush valves, which are manufactured in a pre-determined height to accommodate the deepest tank depth likely to be found, typically requires the installer to hand cut the overflow tube of the flush valve to fit. In the experience of these inventors, it would be unduly expensive to manufacture a variety of different overflow valves, each having an overflow tube of different height, to satisfy the configurations of the various gravity operated flush toilets manufactured in the United States and abroad. It is, therefore, advantageous to provide the after-installation offset outlet flush valve that is constructed in accordance with the present invention with an adjustable overflow tube that would permit plumbers and do-it-yourself homeowners to install the offset outlet flush valve and to adjust the height of its overflow tube as necessary.

SUMMARY OF THE INVENTION

Accordingly, a primary objective of the device of the present invention is to provide an offset outlet flush valve that provides improved flow capacity. It is another object to provide an offset outlet flush valve that can be used in original manufacture toilet fixtures as well as for the after market and that can be readily adapted to the tank profile of a wide variety of gravity operated flush toilets. It is still another object to provide an offset outlet flush valve that can be used with flapper valves of other manufacture such that impingement by the flapper valve bulb within the water flow continuum is minimized. It is yet another object of the device of the present invention to provide such an offset outlet flush valve that is easier to fabricate.

In accordance with the aforementioned objectives of the present invention, there is provided a flush valve having an offset outlet that provides better flow capacity, that is simpler to manufacture and that can be used as equipment in toilets of original manufacture and as replacement after-market devices. The foregoing and other features of the device and method of the present invention will be apparent from the detailed description that follows.

DETAILED DESCRIPTION

Figure 1:
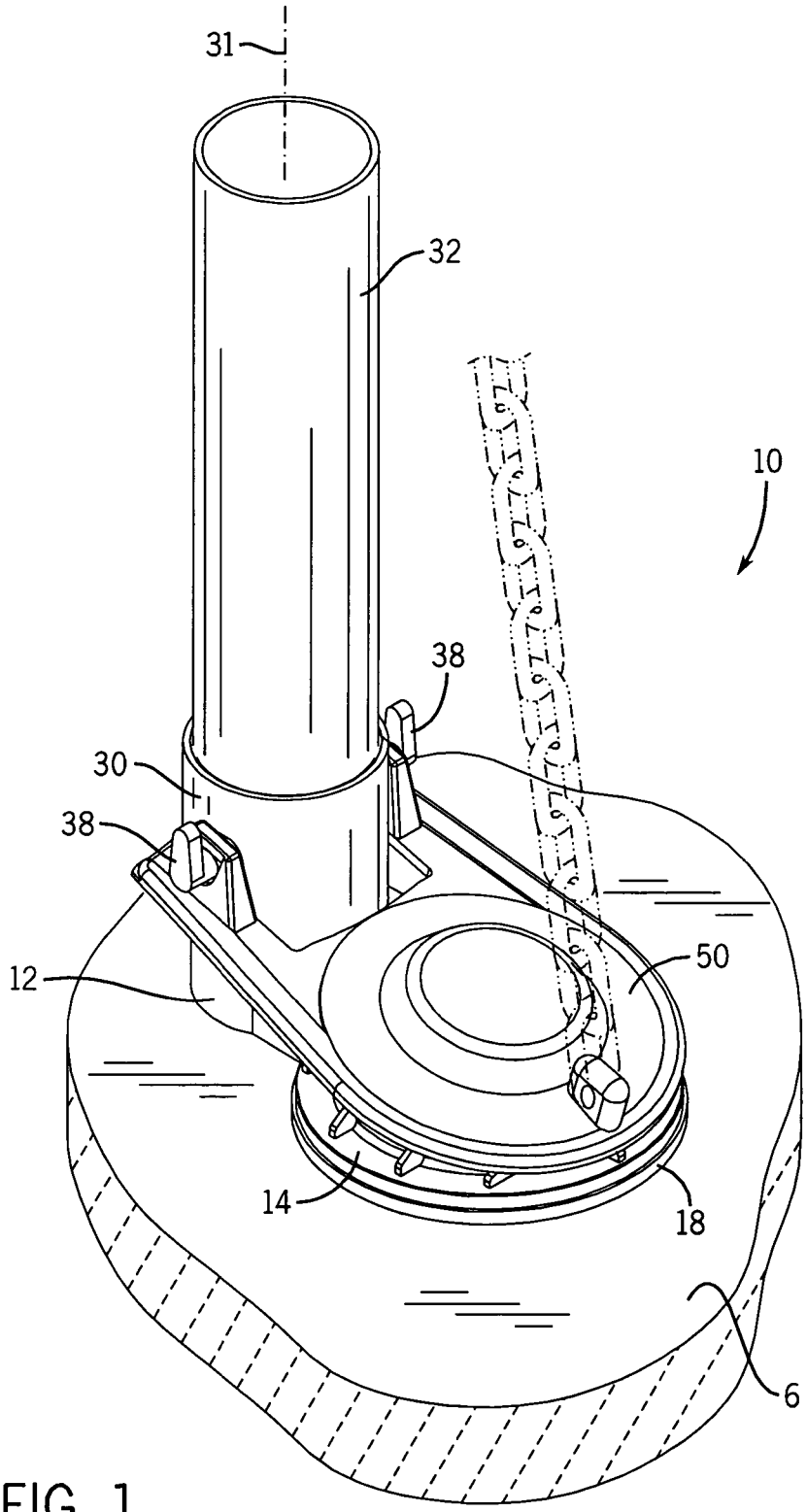
FIG. 1 (PRIOR ART)
FIG. 1 is a top, front and left side perspective view of a flush valve that is known in the art.
Figure 2:
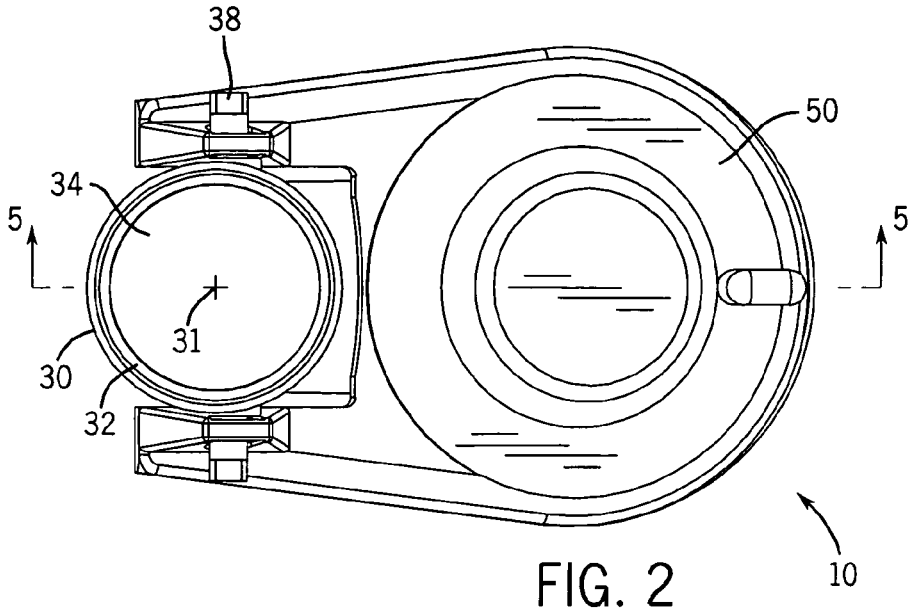
FIG. 2 (PRIOR ART)
FIG. 2 is a slightly enlarged top plan view of the flush valve shown in FIG. 1.
Figure 3:
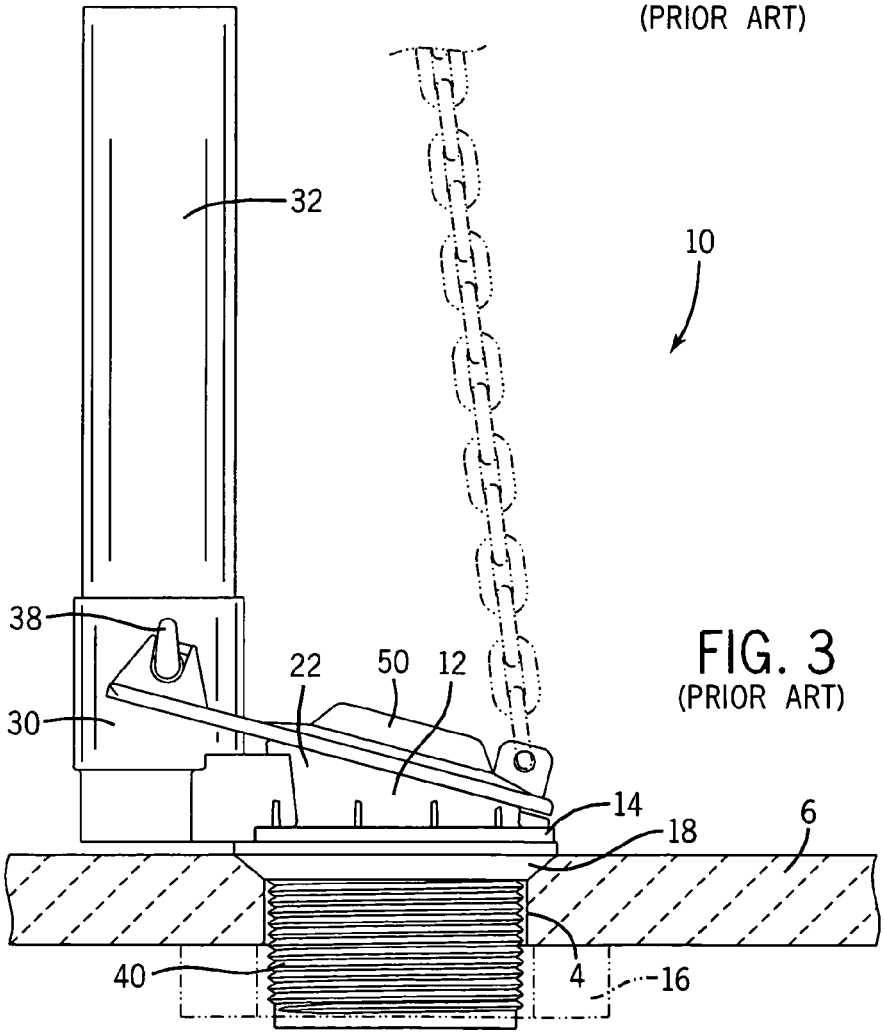
FIG. 3 (PRIOR ART)
FIG. 3 is a side elevational view of the flush valve shown in FIG. 1.
Figure 4:
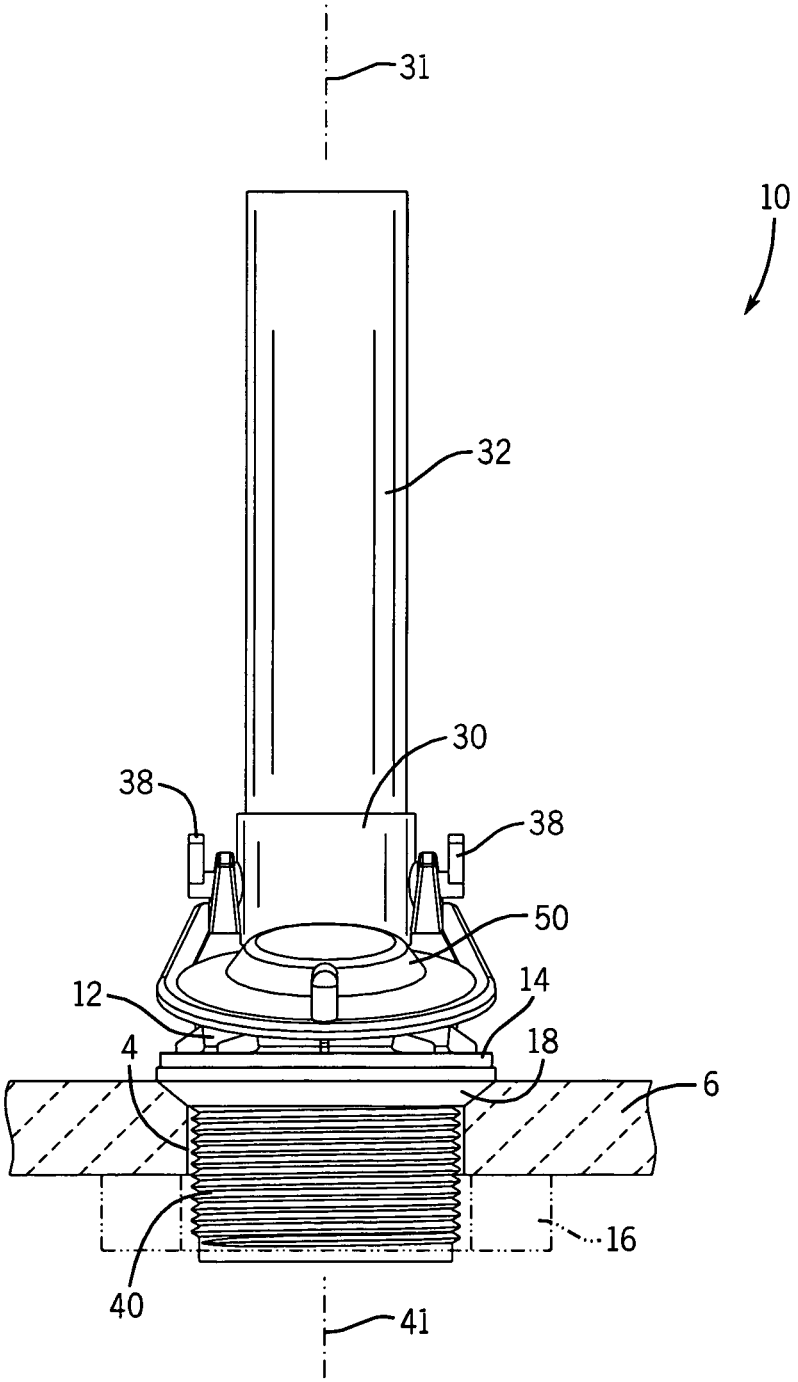
FIG. 4 (PRIOR ART)
FIG. 4 is a front elevational view of the flush valve shown in FIG. 1.
Figure 5:
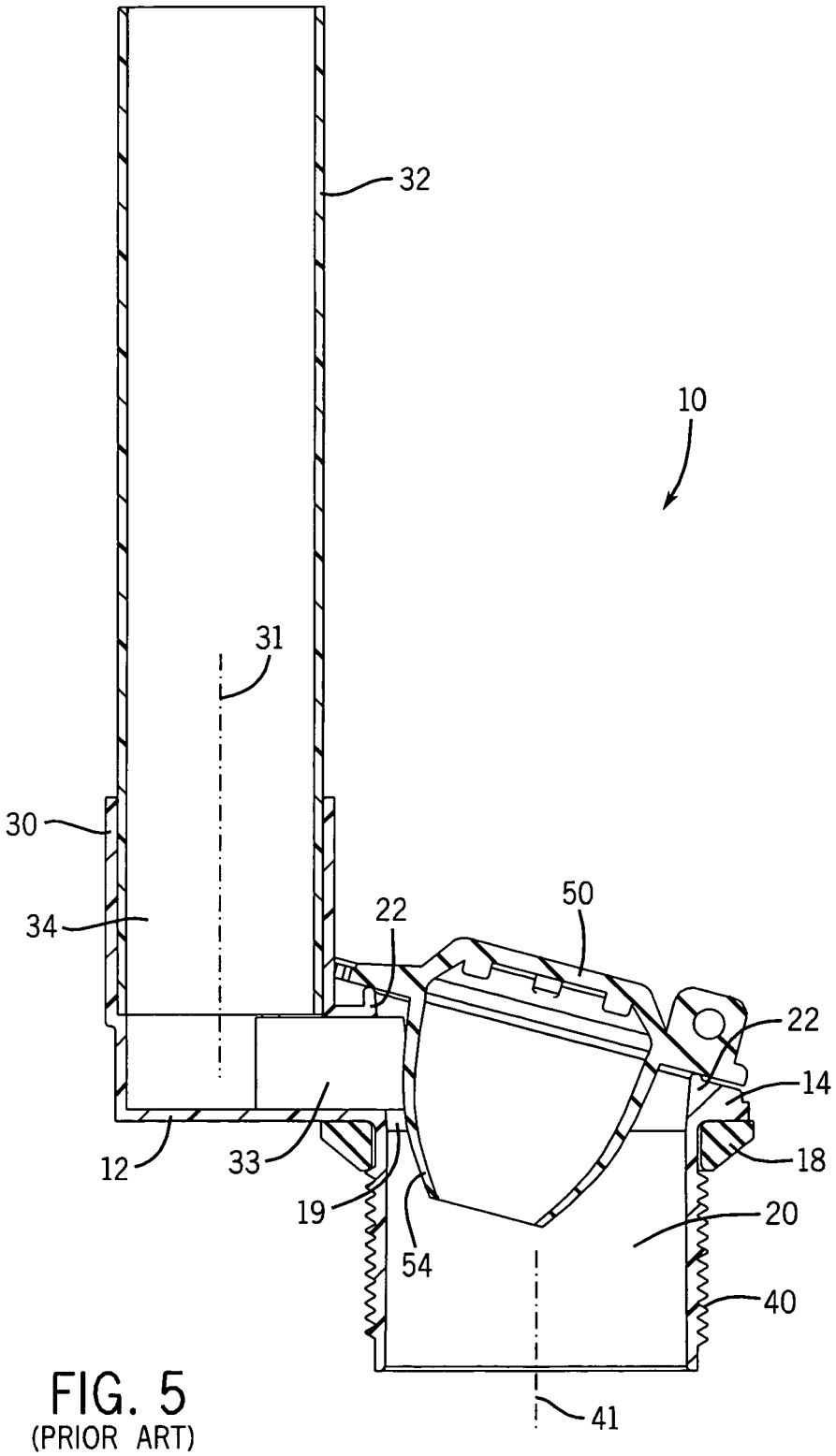
FIG. 5 (PRIOR ART)
FIG. 5 is a slightly enlarged and cross-sectioned side elevational view of the flush valve shown in FIG. 1 and taken along line 5-5 of FIG. 2.
Figure 6:
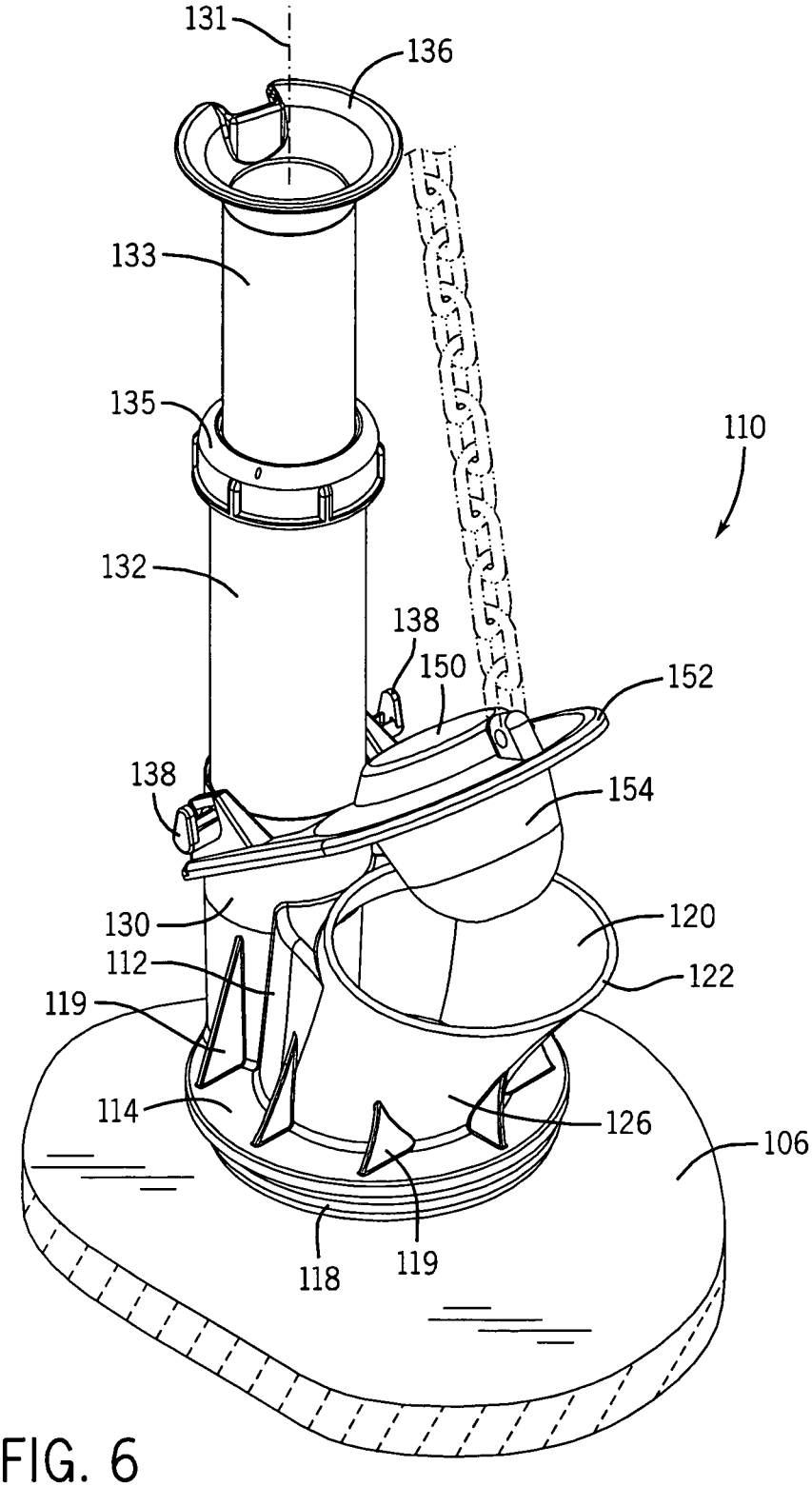
FIG. 6 is a top, front and left side perspective view of a first embodiment of an offset outlet flush valve that is constructed in accordance with the present invention.
Figure 7:
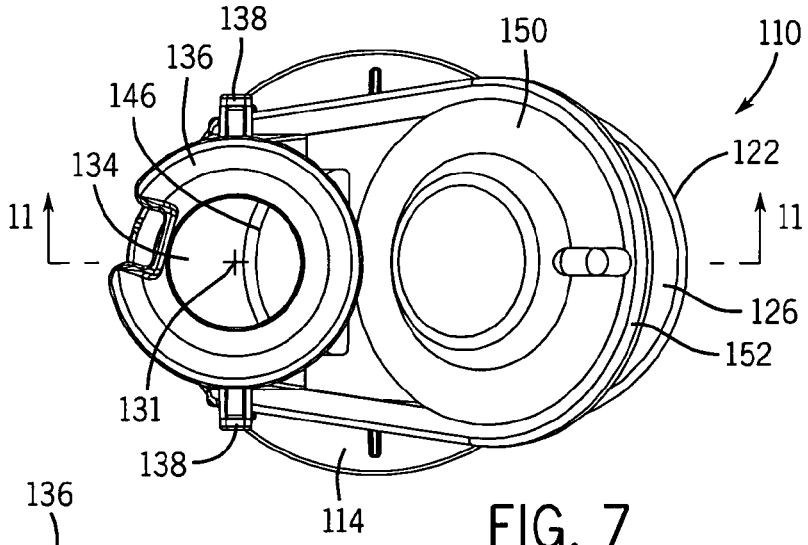
FIG. 7 is a top plan view of the offset outlet flush valve shown in FIG. 6.
Figure 8:
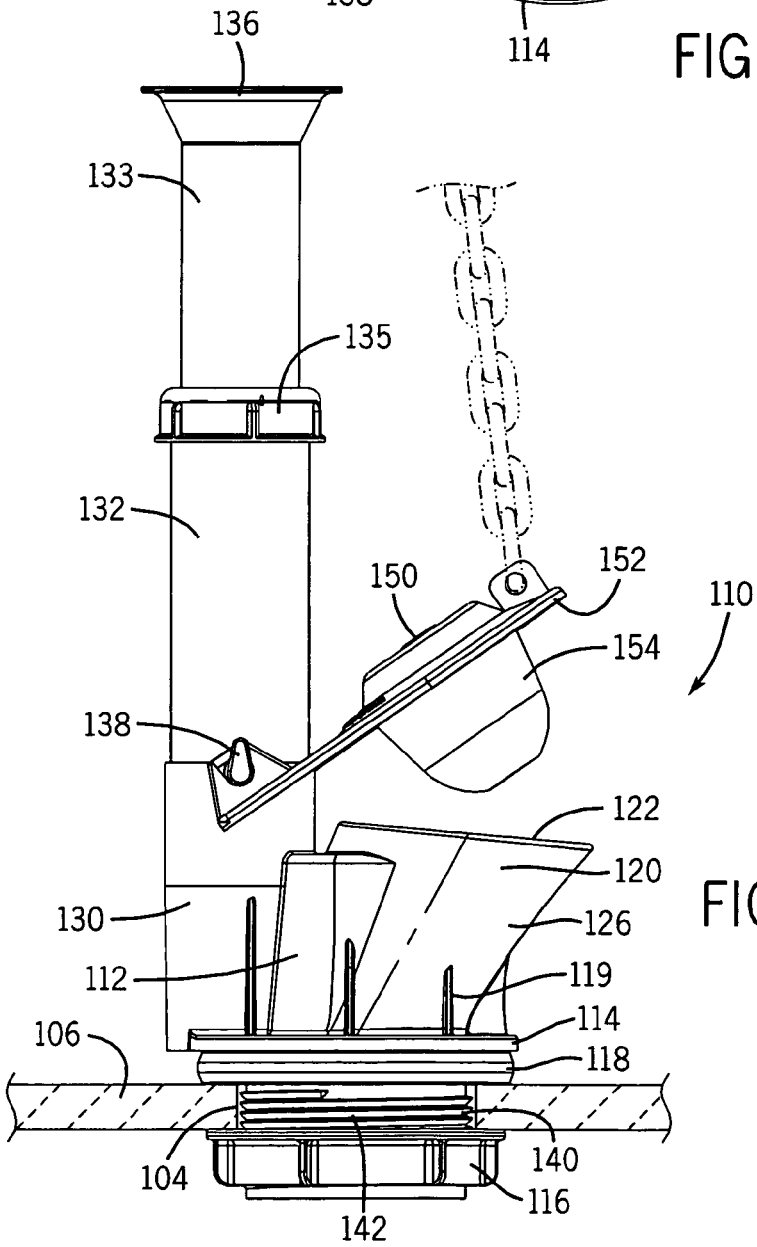
FIG. 8 is a left side elevational view of the offset outlet flush valve shown in FIG. 6.
Figure 9:
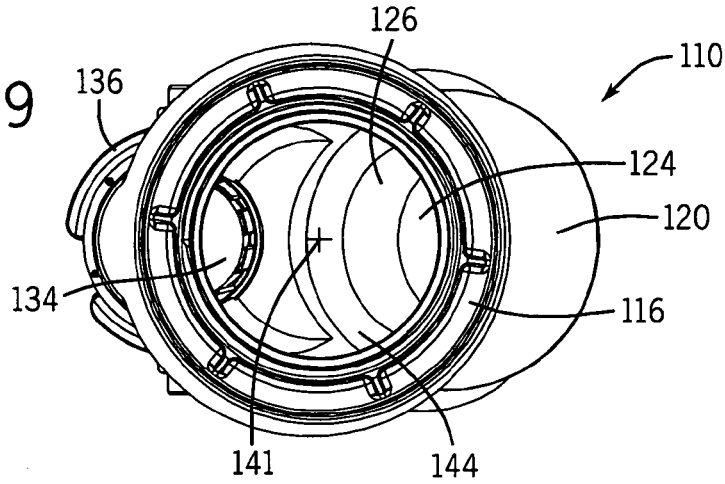
FIG. 9 is a bottom plan view of the offset outlet flush valve shown in FIG. 6.
Figure 10:
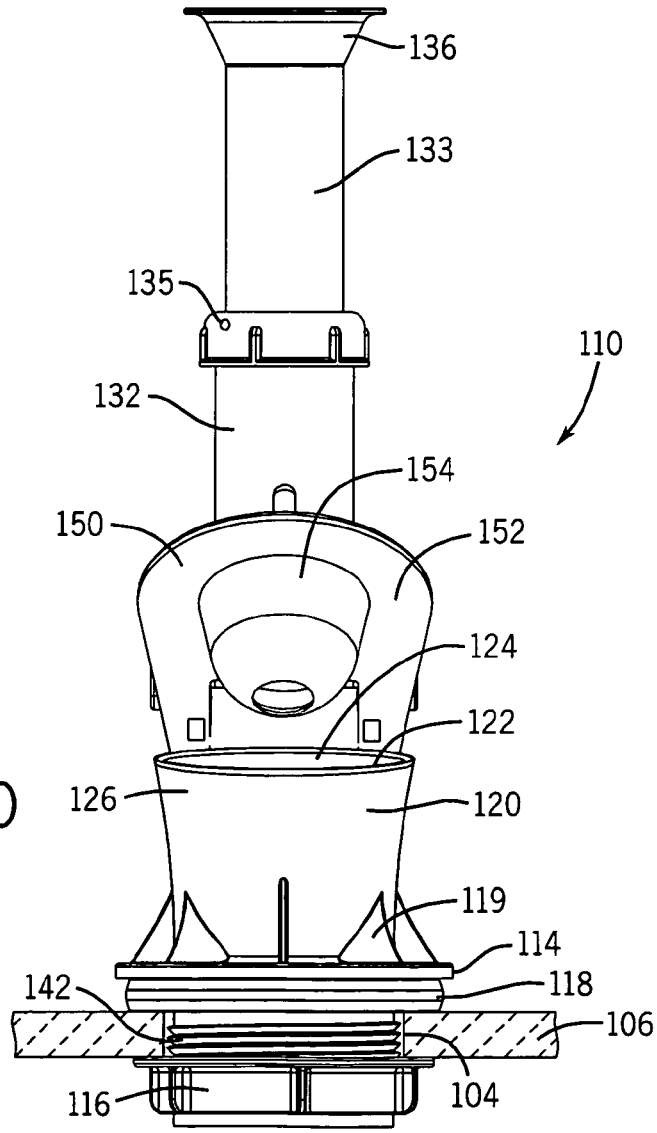
FIG. 10 is a front elevational view of the offset outlet flush valve shown in FIG. 6.

Referring now to the drawings in detail, wherein like-numbered elements refer to like elements throughout, FIGS. 1 through 5 illustrate a conventional flush valve, generally identified 10, of a type that is known in the art. The flush valve 10 includes a valve body 12 that has a generally cylindrical central aperture 20 with a round valve seat 22 upon which a liftable flapper valve 50 can be supported, the flapper valve 50 being rotatable about opposing hooks 38. The valve body 12 is secured within a drain hole 4 located in the bottom wall 6 of the toilet tank. The valve body 12 is supported by a flange 14. A seal member 18 is interposed between the flange 14 and the toilet tank wall 6. Typically, a large nut 16 (shown in phantom view in FIGS. 3 and 4) is screwed over a male threaded lower outlet portion 40 of the cylindrical flush valve body 12, on the underside of the bottom wall 6 of the tank. Extending upwardly from and to one side of the flush valve 12 itself is a cylindrical overflow tube socket 30 having an overflow tube 32 secured within the socket 30. The purpose of the overflow tube 32 is to ensure that a proper water level is maintained within the toilet tank. Ideally, the inlet of the overflow tube 32 is set at a point where it is slightly above normal water level, but below the bottom of the flush lever nut that is located on a vertical wall of the tank for actuation of the flushing cycle. The overflow tube 32 is a vertically-extending circularly-tubular structure having a generally vertical axis 31 and a central aperture 34, the axis 31 and the aperture 34 also forming part of the socket 30. The central aperture 20 of the flush valve 12 itself is similarly a vertically-disposed circular structure having a generally vertical axis 41 and also having a greater inner diameter as compared to the diameter of the overflow tube 32. In the typical configuration, a flow passageway 33 is defined at the bottommost portion of the overflow tube socket 30 whereby a water flow continuum is created between the overflow tube 32, the socket 30, the central passageway 33 and the outlet 40 of the flush valve 10. That is, water flowing into the overflow tube 32 from the tank flows down the overflow tube 32, then flows out of the tube socket 30 at the passageway 33 that is typically disposed at a right angle from the overflow tube 32, into the central aperture 20 of the flush valve body 12, and then flows through the flush valve outlet 40. In this configuration, the bulb 54 of the flapper valve 50 can severely restrict the overflow capacity of the flush valve 10 by impinging on the flow area around the bulb 54, including the much smaller passageway 19 that is located directed between the bulb 54 and the wall of the flush valve outlet 40 at the downstream end of the passageway 33. See especially FIG. 5. This becomes particularly critical when an original equipment manufacturer (OEM) flapper is later replaced with a new flapper, typically manufactured by another company, which is made to some rather arbitrary specifications. Adequate overflow capacity is then overlooked and, if the passageway 19 between the overflow tube socket 30 and the flush valve outlet 40 is blocked, even in part, by the flapper valve bulb 54, then the ability of the overflow tube 32 to do its job is compromised. The flush valve 10 of prior art is also rather difficult to mold as a one-piece item using conventional plastic molding processes as described earlier.

Referring now to FIGS. 6 through 11, they illustrate a first preferred embodiment of the flush valve, generally identified 110, of the present invention as it would be installed within a hole 104 in the bottom wall 106 of a toilet tank. The valve 110 includes a valve body 112 having an inlet 120, an outlet 140 and an overflow tube socket 130. See FIG. 8. The valve body 112 includes a circumferential flange 114, the flange 114 being reinforced by a plurality of upwardly extending ribs 119 disposed along the top side of the flange 114. A seal member 118 is positioned below the flange 114 which provides a watertight seal between the valve body 112 and the bottom wall 106 of the tank. A generally cylindrical nut 116 is internally threaded and rotatable about the outlet 140 of the valve body 112, the outer surface 142 of the outlet 140 also being threaded with cooperating threads. The outlet 140 further includes a generally cylindrical outlet aperture 144, the outlet aperture 144 being defined generally by an outlet sidewall 146. The outlet aperture 144 also has a generally vertical axis 141. See FIG. 11.

The flush valve body 112 also includes an inlet 120. The inlet 120 includes an inlet, or flapper valve, seat 122. Note that the inlet seat 122 is slightly inclined from horizontal and the edge portion of the valve body 112 defining the inlet seat 122 is rounded. See FIGS. 8, 10 and 11. In this way, the inlet seat 122 is configured to allow the peripheral lip 152 of a flapper valve 150 to sealingly rest upon the inlet seat 122. The bulb 154 of the flapper valve 150 sits within an inlet aperture 124, the inlet aperture 124 being defined generally by an inlet sidewall 126. The inlet aperture 124 also includes an axis 121 which is tipped away from vertical. The inlet aperture 124 intersects the outlet aperture 144 of the valve body 112 to form a water flow continuum therebetween. That is, when the flapper valve 150 is pulled upwardly and away from the inlet seat 122, water contained within the tank will flow through the inlet aperture 124 and then through the outlet aperture 144 to the toilet bowl during normal flushing of the toilet.

Figure 11:
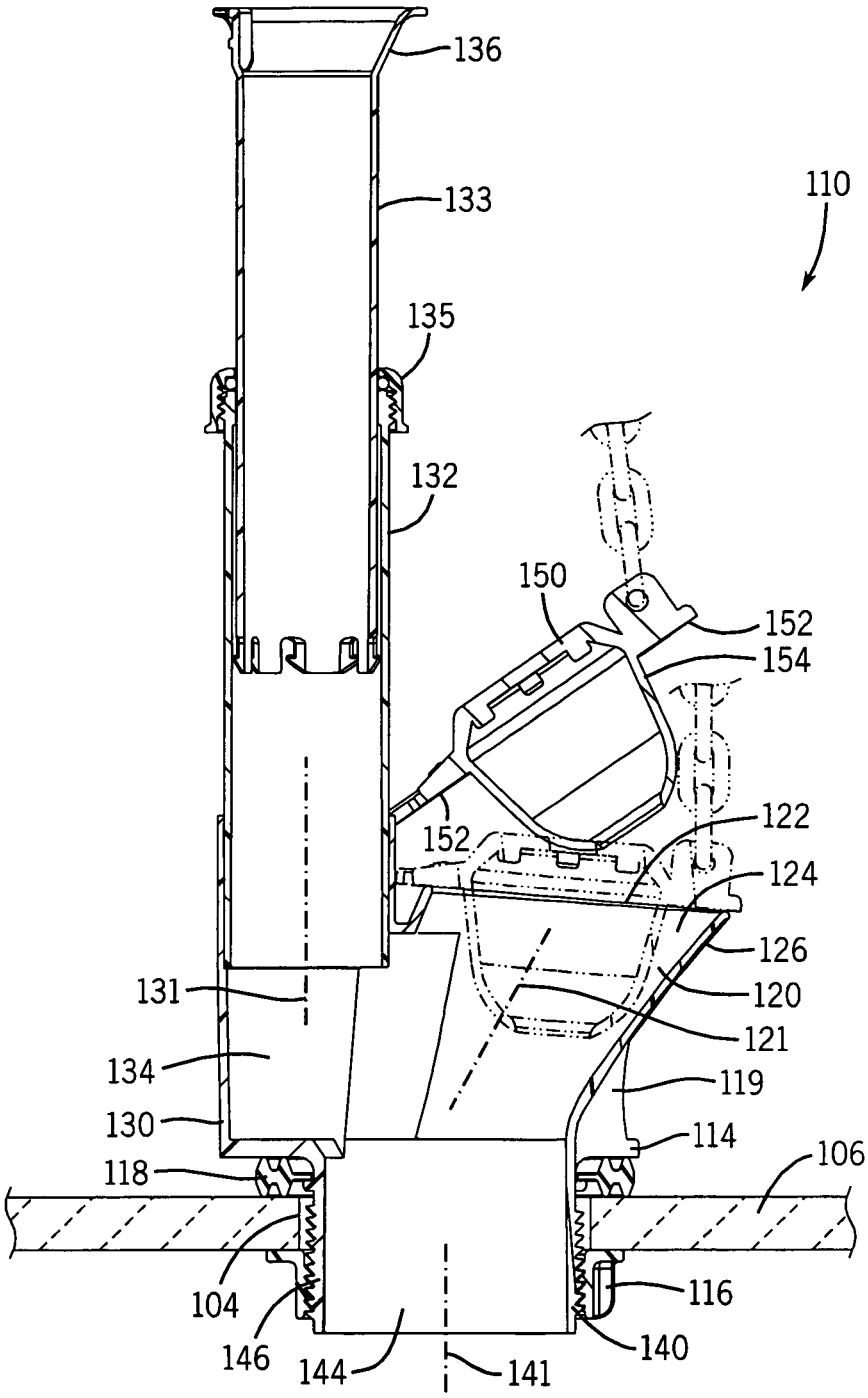
FIG. 11 is a left side and cross-sectioned elevational view of the offset outlet flush valve shown in FIG. 6 and taken along line 11-11 of FIG. 7.

The flush valve body 112 of the present invention further includes an overflow tube socket 130. The overflow tube socket 130 includes a socket aperture 134 that is defined by a socket sidewall 136. The socket aperture 134 has a generally vertical axis 131. The overflow tube socket 130 is functionally adapted to receive a first overflow tube section 132 and an extensible second overflow tube section 133. A compression ring 135 is provided which allows the position of the second overflow tube section 133 to be changed relative to the first overflow tube section 132, the first overflow tube section 132 being fixed in its position relative to the overflow tube socket 130 of the flush valve body 112. In this preferred embodiment, the tube sections 132, 133 are generally cylindrical tubes having slightly different diameters such that the second tube section 133 is slidably received within the first tube section 132 with a small clearance between those sections. The second tube section 133 also includes a flared inlet 136 to increase flow capacity of the overflow tube sections 132, 133 during overflow conditions within the tank. The socket aperture 134 also intersects a portion of the outlet aperture 144 of the valve body 112 to form a water flow continuum therebetween. That is, when water contained within the tank rises to a level that exceeds the fixed height of the tube sections 132, 133, water flows into the overflow tube sections 132, 133, through the socket aperture 134 and then through the outlet aperture 144. This placement of the outlet 144 relative to the socket aperture 134 greatly increases flow during overflow condition since the bulb 154 of the flapper valve 150 does not create a barrier to effective water flow through the valve 112 as it does in the valve of the prior art. See the phantom view of the flapper valve 150 and the flapper valve bulb 154 as shown in FIG. 11.

Although this first embodiment of the offset outlet flush valve 110 could be used with a toilet tank of original manufacture, the height-adjustability feature of the overflow tube sections 132, 133 make this a more attractive choice for after-market applications. A pair of hooks 138 are disposed to either side of the overflow tube socket 130. The purpose of the hooks 138 is to provide the anchoring means for the flapper valve 150, including a replacement flapper valve 150, and about which the flapper valve 150 rotates.

Preferably, the various parts of the offset outlet flush valve 110 are injection molded using a suitable plastic such as ABS plastic or glass filled polypropylene. However, none of the above materials are considered a limitation of the invention. A wide variety of other suitable, durable and low cost materials for injection molding are also available.

Figure 12:
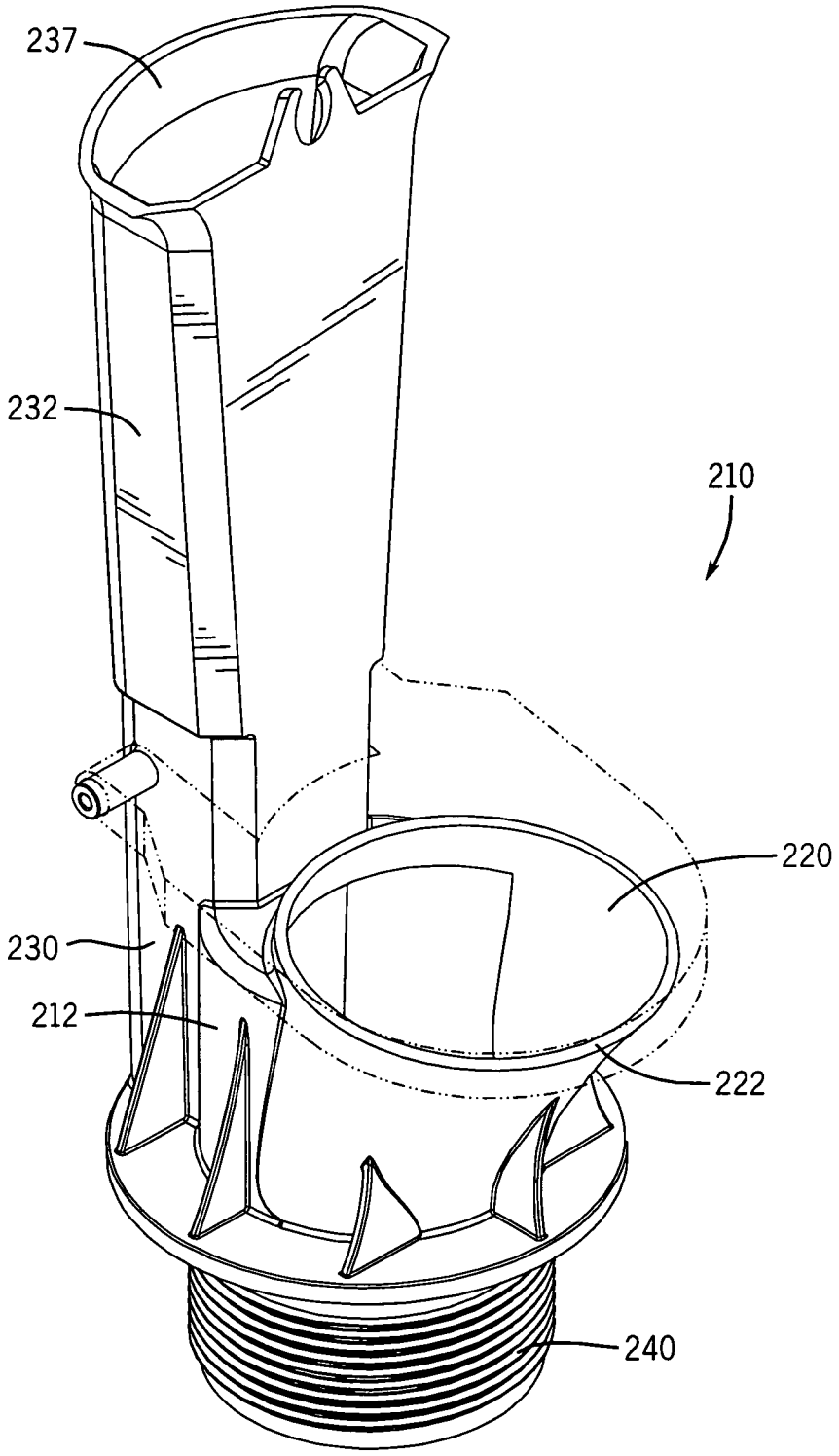
FIG. 12 is a top, front and left side perspective view of a second embodiment of an offset outlet flush valve that is constructed in accordance with the present invention.
Figure 13:
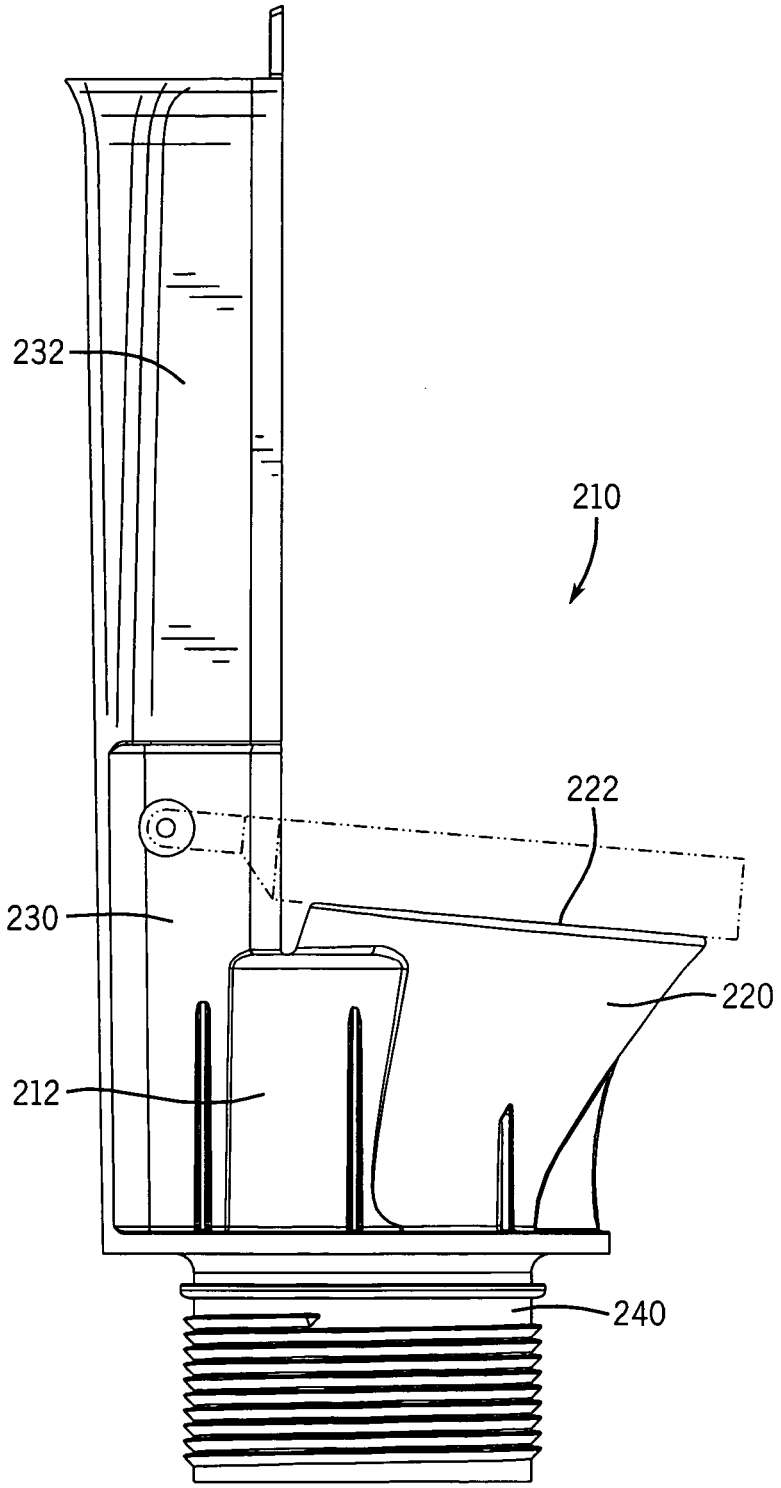
FIG. 13 is a left side elevational view of the offset flush valve shown in FIG. 12.

Referring now to FIGS. 12 and 13, they illustrate a second preferred embodiment of the offset outlet flush valve, generally identified 210, of the present invention. In this alternative embodiment, the flush valve 210 has a valve body 212 that is intended for OEM applications. As shown, the valve body 212 includes an offset outlet 240 which functions in much the same way as that of the first preferred embodiment described above. That is, the outlet 240 is "offset" from the inlet 220 and repositioned to be placed under a portion of the socket 230. This placement of the outlet 240 relative to the socket 230 greatly increases flow during overflow condition since the bulb (not shown) of a flapper valve (shown in phantom view) does not create a barrier to effective water flow through the valve body 212 as it does in the valve of the prior art. The major difference with this embodiment is that the overflow tube 232 is formed as part of the socket 230 and its height is manufactured in accordance with a pre-determined dimension. Also significantly different is the fact that the uppermost portion 237 of the overflow tube 232 is flared to impart even greater flow capacity in an overflow condition. The inlet 220 of the valve body 212 also includes a rim 222 upon which the flapper valve (shown in phantom view) may rest.

Figure 14:
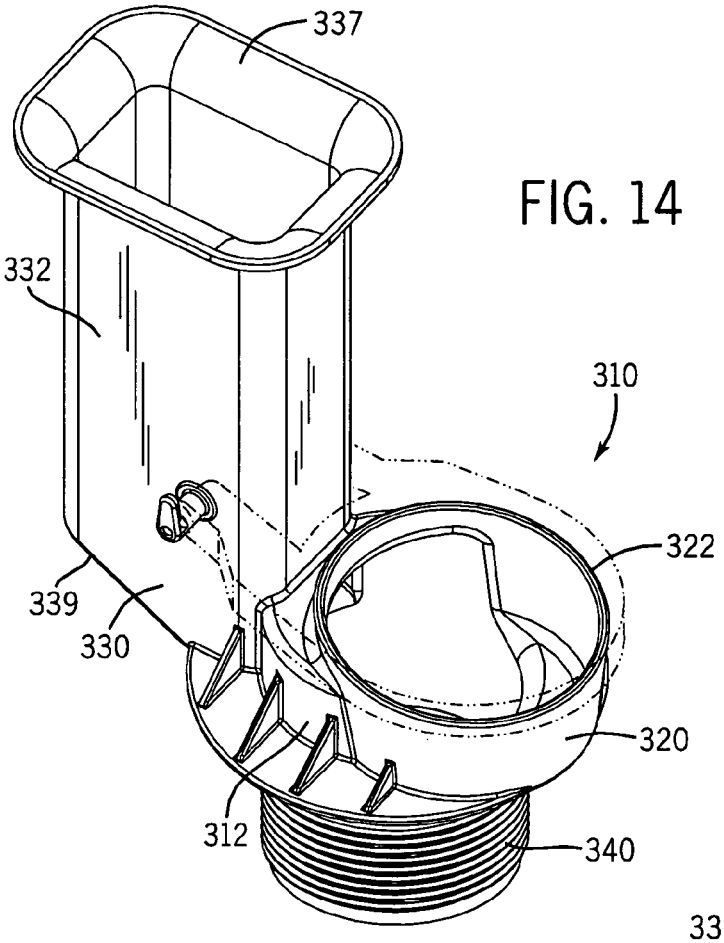
FIG. 14 is a top, front and left side perspective view of a third embodiment of an offset outlet flush valve that is constructed in accordance with the present invention.
Figure 15:
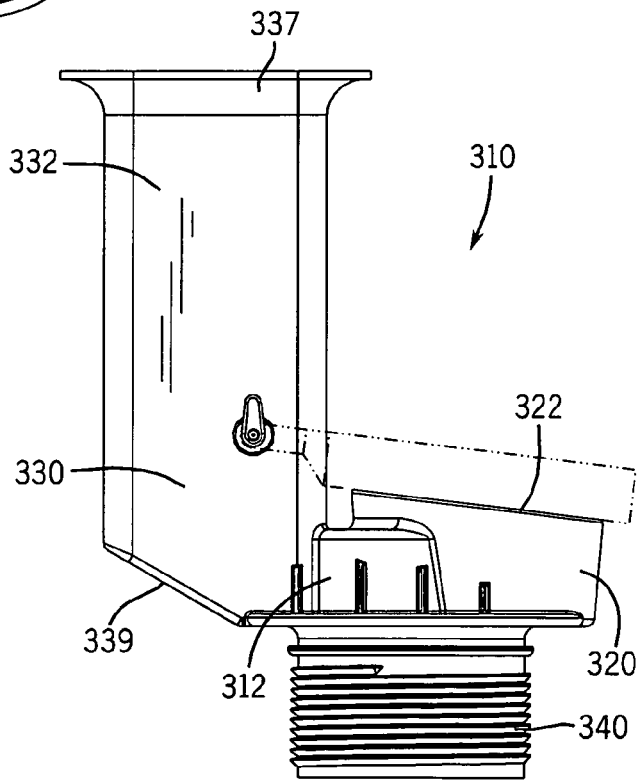
FIG. 15 is a left side elevational view of the offset flush valve shown in FIG. 14.

Referring now to FIGS. 14 and 15, they illustrate a third preferred embodiment of the offset outlet flush valve, generally identified 310, of the present invention. In this alternative embodiment, the flush valve 310 has a valve body 312 that is also intended for OEM applications. As shown, the valve body 312 includes an offset outlet 340 which functions in much the same way as that of the embodiments described above. The outlet 340 is "offset" from the inlet 320. In this embodiment, the overflow tube 332 is also formed as part of the socket 330 and its height is manufactured in accordance with a pre-determined dimension. Also significantly different is the shape of the tube 332, which is generally rectangular in transverse cross-section, and the fact that the bottommost portion 339 of the overflow tube 332 is ramped to impart even greater flow capacity to the flush valve 310 in an overflow condition. This placement of the outlet 340 relative to the socket 330 greatly increases flow during overflow condition since the bulb (not shown) of a flapper valve (shown in phantom view) does not create a barrier to effective water flow through the valve body 312 as it does in the valve of the prior art. The uppermost portion 337 of the overflow tube 332 is flared to further improve flow capacity during overflow conditions. The inlet 320 of the valve body 312 also includes a rim 322 upon which the flapper valve (shown in phantom view) may rest.

Figure 16:
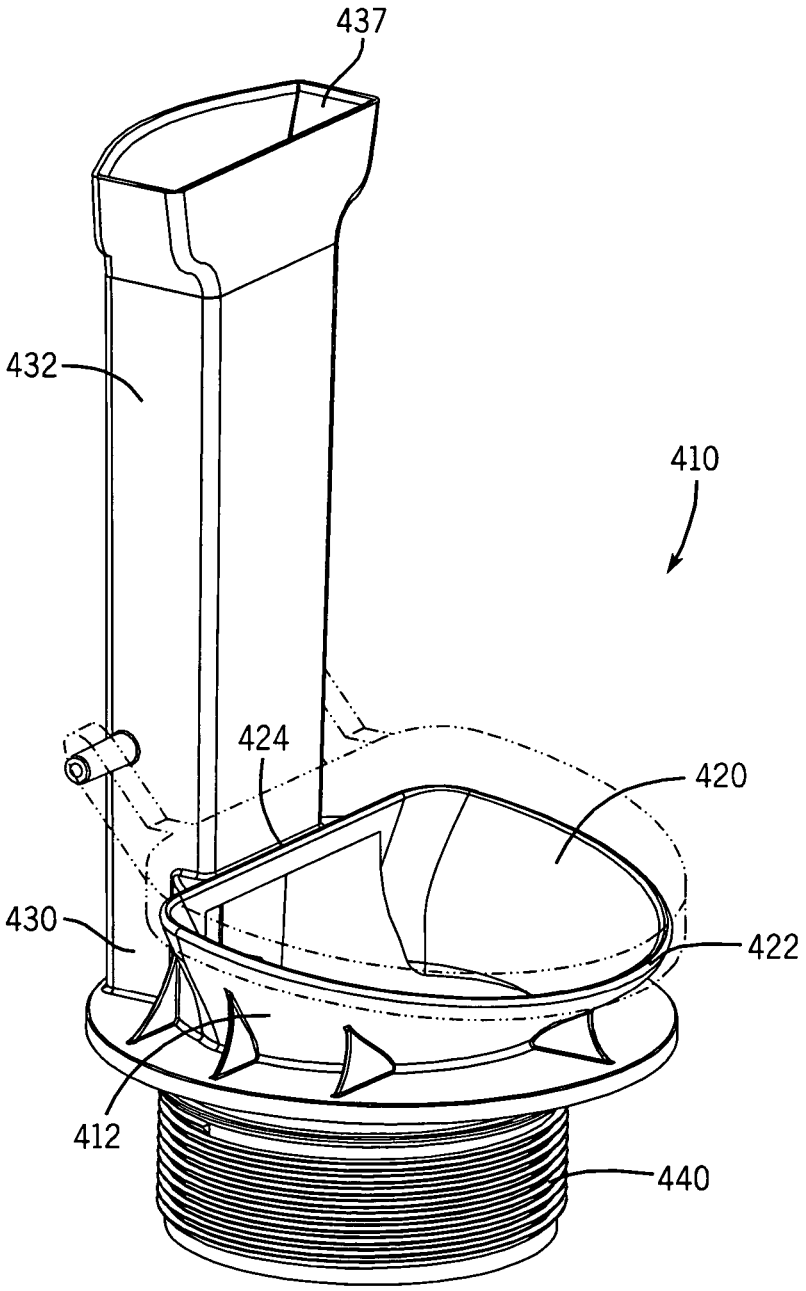
FIG. 16 is a top, front and left side perspective view of a fourth embodiment of an offset outlet flush valve that is constructed in accordance with the present invention.
Figure 17:
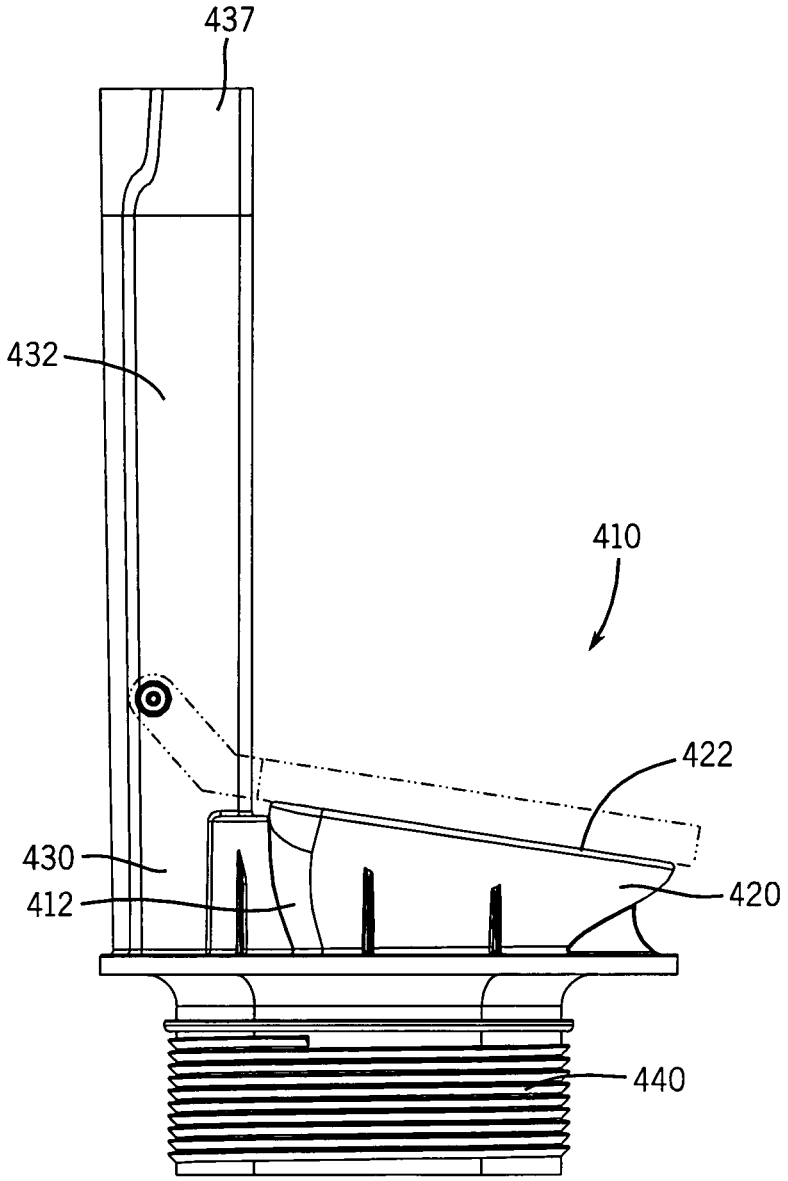
FIG. 17 is a left side elevational view of the offset flush valve shown in FIG. 16.

Referring now to FIGS. 16 and 17, they illustrate a fourth preferred embodiment of the offset outlet flush valve, generally identified 410, of the present invention. In this alternative embodiment, the flush valve 410 has a valve body 412 that is similarly intended for OEM applications. As shown, the valve body 412 includes an offset outlet 440 which also functions in much the same way as that of each of the other preferred embodiments described above. The overflow tube 432 of this embodiment is again formed as part of the socket 430 and its height is manufactured in accordance with a pre-determined dimension. Also different is the fact that the uppermost portion 437 of the overflow tube 432 is flared to impart even greater flow capacity in an overflow condition. The placement of the outlet 440 more closely to the socket 430 greatly increases flow during overflow condition since the bulb (not shown) of a flapper valve (shown in phantom view) does not create a barrier to effective water flow through the valve body 412 as it does in the valve of the prior art. The inlet 420 of the valve body 412 also includes a rim 422 upon which the flapper valve (shown in phantom view) may rest. Another difference with this embodiment is the fact that the rim 422 has a "flattened" portion 424 at its point closest to the socket 430 and overflow tube 432. While this embodiment would require the use of a particularly formed flapper valve as compared to the other embodiments described above, the flush valve 410 of this embodiment is more compact in is front-to-back dimension, thus taking up less space in the toilet tank (also not shown).

The present invention also provides a method for making the offset outlet flush valve bodies 112, 212, 312, 412 of the present invention. Each of the flush valves 110, 210, 310, 410 described above eliminates the requirement of molding the lateral section of the passageway through the valve body separately, as was required to be done with valve bodies of the prior art, thus simplifying the mold process, reducing costs, and increasing the durability of the goods. In some processes, complicated retracting mold cores would also be used. All of these disadvantages are avoided by offsetting the outlets 140, 240, 340, 440 of the flush valves 110, 210, 310, 410, respectively, and in particular, the axis 141, in the flush valve 110 of the first preferred embodiment, such that the retracting mold for the bottom of the valve body and the retracting mold for the overflow tube meet, or nearly meet, thus eliminating the need for an extra horizontal, or lateral, connection, or retracting mold. In the first preferred embodiment, the axis 141 of the outlet aperture 144 is located closer to the axis 131 of the overflow aperture 134 and the axis 121 of the inlet aperture 124 is tipped away from the vertical, as shown in FIG. 11.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

From the foregoing detailed description of the illustrative embodiment of the invention set forth herein, it will be apparent that there has been provided a new, useful and uncomplicated toilet flush valve having an offset outlet and a method for making the offset outlet flush valve.

The principles of this invention being described in accordance with the foregoing, we claim as our invention the following:

1. An offset outlet flush valve which comprises
a valve body,
an inlet comprising an inlet aperture,
an overflow tube socket comprising an overflow tube aperture, the overflow tube aperture comprising a generally cylindrically-shaped structure that is positioned substantially vertically and having an axis, and
an outlet comprising an outlet aperture, the outlet aperture comprising a generally cylindrically-shaped structure that is positioned substantially vertically and having an axis, the outlet aperture being disposed forwardly of the inlet aperture but intersecting a portion of the inlet aperture and a portion of the overflow tube aperture such that a portion of the outlet aperture overlays the intersected portion of the overflow tube aperture and such that the axis of the overflow tube is positioned rearwardly of the axis of the outlet aperture structure,
wherein a water flow continuum is created between the inlet aperture and the outlet aperture and between the overflow tube aperture and the outlet aperture.

2. The flush valve of claim 1 wherein the inlet aperture comprises a generally cylindrically-shaped structure that is positioned at an angle away from vertical.

3. The flush valve of claim 1 wherein the overflow tube aperture is adapted to sealingly receive at least one overflow tube within it.

4. The flush valve of claim 3 wherein the at least one overflow tube is cylindrically-shaped in cross-section.

5. The flush valve of claim 1 wherein the overflow tube aperture forms part of a unitary and upwardly-extending overflow tube that is upwardly-flared in cross-section.

6. The flush valve of claim 1 wherein the overflow tube aperture forms part of a unitary and upwardly-extending overflow tube that is generally rectangularly-shaped in cross-section.

7. The flush valve of claim 1 wherein the inlet aperture is flattened to one side and cylindrical to the opposing side.

8. An offset outlet flush valve which comprises
a unitary valve body,
an inlet comprising an inlet aperture that is defined by an inlet sidewall,
an overflow tube socket comprising an overflow tube aperture that is defined by a sidewall, and
an outlet comprising an outlet aperture that is defined by an outlet sidewall, the outlet sidewall intersecting the inlet sidewall and also intersecting a portion of the overflow tube sidewall,
wherein the outlet sidewall is not common with the overflow tube sidewall and a water flow continuum is created along the inlet aperture sidewall to the outlet aperture sidewall and also along the overflow tube aperture sidewall to the outlet aperture sidewall.

9. The flush valve of claim 8 wherein the overflow tube aperture sidewall comprises a generally cylindrically-shaped structure being substantially vertical.

10. The flush valve of claim 8 wherein the outlet aperture sidewall comprises a generally cylindrically-shaped structure being substantially vertical.

11. The flush valve of claim 8 wherein the inlet aperture sidewall comprises a generally cylindrically-shaped structure that is tipped at an angle away from vertical.

12. The flush valve of claim 8 wherein the overflow tube aperture sidewall is adapted to sealingly receive at least one overflow tube within it.

13. The flush valve of claim 12 wherein the at least one overflow tube is cylindrically-shaped in cross-section.

14. The flush valve of claim 8 wherein the overflow tube aperture sidewall forms part of a unitary and upwardly-extending overflow tube sidewall that is upwardly-flared in cross-section.

15. The flush valve of claim 8 wherein the overflow tube aperture sidewall forms part of a unitary and upwardly-extending overflow tube sidewall that is generally rectangularly-shaped in cross-section.

16. The flush valve of claim 8 wherein the inlet aperture sidewall is flattened to one side and cylindrical to the opposing side.

* * * * *